US010221060B2

(12) United States Patent
Ishida et al.

(10) Patent No.: US 10,221,060 B2
(45) Date of Patent: Mar. 5, 2019

(54) MICROVOLUME-LIQUID DISPENSING METHOD AND MICROVOLUME-LIQUID DISPENSER

(71) Applicant: ENGINEERING SYSTEM CO., LTD., Matsumoto-shi, Nagano (JP)

(72) Inventors: Shinya Ishida, Matsumoto (JP); Kentaro Fukuda, Matsumoto (JP)

(73) Assignee: ENGINEERING SYSTEM CO., LTD., Matsumoto-Shi, Nagano (JP)

( * ) Notice: Subject to any disclaimer, the term of this patent is extended or adjusted under 35 U.S.C. 154(b) by 207 days.

(21) Appl. No.: 15/119,295

(22) PCT Filed: May 12, 2015

(86) PCT No.: PCT/JP2015/063547
§ 371 (c)(1),
(2) Date: Aug. 16, 2016

(87) PCT Pub. No.: WO2015/178239
PCT Pub. Date: Nov. 26, 2015

(65) Prior Publication Data

US 2017/0008755 A1 Jan. 12, 2017

(30) Foreign Application Priority Data

May 20, 2014 (JP) ..... 2014-104228
Mar. 10, 2015 (JP) ..... 2015-046897
Mar. 24, 2015 (JP) ..... 2015-061715

(51) Int. Cl.
*B67D 99/00* (2010.01)
*B05C 5/02* (2006.01)
(Continued)

(52) U.S. Cl.
CPC ..... *B67D 99/00* (2013.01); *B05B 1/086* (2013.01); *B05C 11/1034* (2013.01);
(Continued)

(58) Field of Classification Search
None
See application file for complete search history.

(56) References Cited

U.S. PATENT DOCUMENTS 6,387,330 B1 * 5/2002 Bova ..... B01J 19/0046 141/102
2006/0147313 A1 * 7/2006 Zengerle ..... B01L 3/0268 417/53
2015/0261089 A1 * 9/2015 Zhou ..... B67D 7/0294 137/571

FOREIGN PATENT DOCUMENTS

JP 60-174867 U 11/1985
JP 60-189834 U 12/1985
(Continued)

OTHER PUBLICATIONS

International Search Report (PCT/ISA/210) dated Aug. 18, 2015, by the Japanese Patent Office as the International Searching Authority for International Application No. PCT/JP2015/063547.
(Continued)

*Primary Examiner* — Jethro M. Pence
(74) *Attorney, Agent, or Firm* — Buchanan Ingersoll & Rooney PC

(57) ABSTRACT

Provided is a microvolume liquid dispensing method in which a variable capacity passage section of a liquid passage in a microvolume liquid dispenser is pressurized from the outside and shrunk in a direction that reduces the internal capacity thereof so that a liquid that is within the variable capacity passage section is pushed toward both a downstream passage section and an up stream passage section. A microvolume of the liquid is pushed toward the downstream passage section as a result of the downstream passage section having a much larger liquid passage resistance than the upstream passage section. It is thus possible to precisely
(Continued)

drip a microvolume liquid of a picoliter order from the tip opening of a nozzle by simple control.

18 Claims, 8 Drawing Sheets

(51) Int. Cl.

| | |
|---|---|
| ***B67D 7/02*** | (2010.01) |
| ***B05C 11/10*** | (2006.01) |
| ***B05B 1/08*** | (2006.01) |
| *B05D 1/26* | (2006.01) |
| *B01L 3/02* | (2006.01) |

(52) U.S. Cl.
CPC ..... *B67D 7/0261* (2013.01); *B01L 3/0268* (2013.01); *B05C 5/02* (2013.01); *B05D 1/26* (2013.01); *B67D 2210/0016* (2013.01)

(56) References Cited

FOREIGN PATENT DOCUMENTS

| | | | |
|---|---|---|---|
| JP | H10-57866 | A | 3/1998 |
| JP | 3564361 | B | 9/2004 |
| JP | 2005-797 | A | 1/2005 |
| JP | 2007-502399 | A | 2/2007 |
| JP | 2010-64359 | A | 3/2010 |
| JP | 2013-208613 | A | 10/2013 |
| JP | 2014-74349 | A | 4/2014 |

OTHER PUBLICATIONS

Written Opinion (PCT/ISA/237) dated Aug. 18, 2015, by the Japanese Patent Office as the International Searching Authority for International Application No. PCT/JP2015/063547.

* cited by examiner (a)

(b)

(c)

MICROVOLUME-LIQUID DISPENSING METHOD AND MICROVOLUME-LIQUID DISPENSER

TECHNICAL FIELD

The present invention relates to a microvolume-liquid dispenser and a microvolume-liquid dispensing method that make it possible to discharge, perform dropwise addition of, or otherwise dispense nanoliter quantities of a microvolume liquid, and even picoliter quantities thereof, using a nozzle having a very small diameter of, e.g., 0.5 mm or less. The continuous discharge, intermittent discharge, continuous dropwise addition, and intermittent dropwise addition of a liquid from a nozzle are collectively referred to as "dispensing."

BACKGROUND ART

Pneumatic liquid dispensers are known as mechanisms for discharging, or performing dropwise addition of, a liquid onto a substrate surface or the like. In liquid dispensers, a pump or other pressurizing element is used to pressurize a liquid, and the liquid is added dropwise or discharged from a nozzle of a prescribed diameter and applied to a target substrate surface or the like. Patent Documents 1-3 describe such liquid dispensers.

Additionally, it is difficult to form fine patterns in semiconductor manufacturing steps and the like by using pneumatic liquid dispensers, and thus electrostatic-discharge-scheme liquid discharge heads or the like are used in such applications. The inventors proposed such a liquid discharge head in Patent Document 4.

A micro-flow meter for metering and dispensing liquids was proposed in Patent Document 5. The proposed micro-flow meter comprises a flexible tube of fixed inner diameter through which a liquid is supplied from a liquid container, the micro-flow meter being configured such that the flexible tube is compressed by a pushing device driven by a piezoelectric actuator, and a microvolume of a liquid is discharged from an outlet hole formed in one end of the flexible tube.

Variations in volume due to the fast movement of the pushing device create a flow of liquid toward the outlet hole of the flexible tube, while creating a backflow of liquid through an inlet passage to the liquid container. Additionally, the pushing device is positioned close to the outlet hole, and in portions where the flexible tube is pushed by the pushing device, the liquid impedance on the outlet-hole side is lower than the liquid impedance on the upstream inlet-passage side, causing the majority of the pushed-out liquid to be discharged from the outlet hole. Furthermore, the surface of the flexible tube pushed by the pushing device is formed into an inclined surface set back toward the outlet-hole side; when the flexible tube is pressed by a pressing device, a large amount of liquid is pushed out toward the outlet side. Specifically, in order to determine the discharge amount according to the pipeline-resistance ratio and quickly discharge the liquid from the outlet hole, the flexible tube is deformed so as to assume an axially asymmetrical state.

PRIOR ART DOCUMENTS

Patent Documents

Patent Document 1: JP Hei10-57866 A
Patent Document 2: JP 3564361 B
Patent Document 3: JP 2005-797 A Patent Document 4: JP 2010-64359 A
Patent Document 5: JP 2007-502399 A

DISCLOSURE OF THE INVENTION

Problems to be Solved by the Invention

In the case of electrostatic-discharge-scheme liquid discharge heads, the electrostatic force produced between the head and the target substrate is used. Therefore, a restriction is presented in that the material to be discharged is limited to non-conductive materials (dielectric or high-κ materials). It is also possible to use piezo-drive-type and other drive-type liquid discharge heads, but this presents a difficulty in discharging, or performing dropwise addition of, high-viscosity liquids. For example, it is difficult to discharge or perform dropwise addition of UV-curable resins and other high-viscosity liquid resin materials, as well as Ag paste and other high-viscosity metal pastes, in nanoliter quantities or picoliter quantities.

It is thought that the nozzle diameter of pneumatic and other types of liquid dispensers is set to a very small diameter of 500 μm or less; e.g., 100 μm or less, and fine droplets can be added dropwise or discharged. However, it is difficult to discharge a liquid from a nozzle of such very small diameter at a very small fixed flow rate. For example, because the pipeline resistance of a narrow nozzle is high, it is difficult to discharge, or perform dropwise addition of, a liquid from the nozzle even when the pressurized force of the liquid supplied to the nozzle is high.

Additionally, when the pressurized force of the liquid is increased, the liquid pressure inside the nozzle temporarily decreases after a large amount of liquid is added dropwise or discharged once from the nozzle; therefore, the discharge or dropwise addition of the liquid is unstable. This process is repeated, making it impossible to intermittently discharge, or perform dropwise addition of, nanoliter quantities or picoliter quantities of a microvolume liquid.

However, in the micro-flow meter proposed in Patent Document 5, a portion of the very-small-diameter flexible tube is compressed into an axially asymmetrical deformed state by the pushing device, which is driven by the piezoelectric actuator, so that the liquid is pushed out to the outlet-hole side. Compressing the flexible tube into an axially asymmetrical state causes the liquid to be substantially pushed out toward the outlet hole (toward the downstream side) and quickly discharged from the outlet hole.

In order to control the discharged droplets to a very small amount; i.e., nanoliter quantities or picoliter quantities, the amount of compressing of the flexible tube needs to be very small. To that end, it is necessary to precisely produce the flexible tube and precisely drive and control the piezoelectric actuator. Additionally, it is necessary to compress the flexible tube into an axially asymmetrical state so that the liquid is quickly pushed out toward the outlet side; therefore, it is necessary to precisely process the shape and other attributes of the pressure surface of the pushing device.

However, it is impossible to manufacture a mechanism for accurately compressing a very small amount of a portion of a very-small-diameter flexible tube and pushing out nanoliter-quantity or picoliter-quantity very small amounts of liquid using photolithography or another technique, such as in the case of an electrostatic-drive-scheme or piezo-drive-scheme inkjet head; therefore, costs are incurred in precisely producing the very small mechanism, making such a mechanism impracticable.

Additionally, the outlet hole for discharging the droplets is formed in the tip of the flexible tube. Therefore, when the tube section extending from the portion compressed by the pushing device to the outlet hole is deformed, the amount of droplets discharged from the outlet hole might fluctuate. For example, when the internal pressure of the flexible tube pressed by the pushing device fluctuates, the tube section close to the outlet hole is correspondingly deformed, leading to the concern that the amount of discharged droplets might vary and that it might be impossible to precisely discharge microvolume droplets.

In view of such drawbacks, an object of the present invention is to provide a microvolume-liquid dispensing method and a microvolume-liquid dispenser that make it possible to precisely dispense nanoliter quantities of a microvolume liquid, and even picoliter quantities thereof, through an inexpensive configuration using a nozzle having a very small diameter of, e.g., 500 μm or less.

Means to Solve the Problems

In order to overcome the aforementioned problem, according to the present invention, there is provided a microvolume-liquid dispensing method for dispensing a nanoliter-quantity to picoliter-quantity microvolume liquid from a tip-end opening in a tubular nozzle, the method being characterized in that:

a liquid passage for supplying liquid from a liquid supply part to the nozzle is formed from an upstream-side passage section, an intermediate passage section, and a downstream-side passage section, the intermediate passage section being capable of expanding and contracting so as to increase or decrease in interior volume;

in a case in which the intermediate passage section is deformed such that the interior volume thereof is reduced while a liquid-filled state is attained in which the liquid fills the portion from the liquid passage to the tip-end opening of the nozzle, the ratio of the amount of liquid pushed out from the intermediate passage section to the downstream-side passage section and the amount of liquid pushed back to the upstream-side passage section is set to 1:100-1:500 so that the amount of pushed-out liquid reaches a very small amount; i.e., nanoliter quantities or picoliter quantities;

and, in the operation for dispensing the microvolume liquid, the liquid-filled state is attained;

the intermediate passage section is deformed such that the interior volume thereof is reduced;

the microvolume liquid is dispensed from the tip-end opening of the nozzle due to the very small amount of liquid pushed out from the intermediate passage section to the downstream-side passage section; and the deformation of the intermediate passage section is stopped to return the interior volume of the intermediate passage section to the original volume, draw a very small amount of liquid back into the intermediate passage section from the downstream-side passage section, and draw liquid into the intermediate passage section from the upstream-side passage section.

In order to dispense nanoliter quantities or picoliter quantities of a microvolume liquid, a nozzle of very small diameter is used. In conventional practice, the liquid is supplied from a liquid supply source to the nozzle via a liquid passage while in a prescribed state of pressurization. In cases in which the nozzle opening diameter is small, when the liquid passage resistance in the nozzle is high and the liquid supply pressure cannot be increased, it is impossible to discharge, or perform dropwise addition of, the liquid from the nozzle. When the liquid supply pressure is increased, a large amount of liquid might be added dropwise or discharged once from the nozzle, making the discharge or dropwise addition of the liquid unstable. It is therefore difficult to precisely dispense microvolume liquid onto a member surface or the like. In particular, in the case of a highly viscous liquid resin, a highly viscous metal paste, or another highly viscous liquid material, it is very difficult to precisely dispense the microvolume liquid.

In the present invention, after the liquid is supplied via the liquid passage to the tip-end opening to fill the nozzle, an intermediate passage section midway along the liquid passage is subjected to external pressure or the like, and is caused to deform in a direction such that the interior volume thereof is reduced; e.g., to contract. The liquid held in the intermediate passage section is thereby pushed out to the downstream-side passage section and pushed back to the upstream-side passage section.

When the upstream side of the intermediate passage section is blocked by an opening/closing valve or the like, and when the intermediate passage section is caused to contract due to external pressure while in this state to push the liquid out to the nozzle, a strong pressure is applied directly to the nozzle. In this case, a large amount of liquid might be added dropwise or discharged once from the tip-end opening of the nozzle. It is very difficult to minutely adjust the deformation amount; e.g., contraction amount of the intermediate passage section in order to control the liquid pressure acting on the nozzle tip-end opening to a suitable value.

In the present invention, when the intermediate passage section deforms, liquid flows are formed toward both the downstream side (nozzle side) and the upstream side. Suitably setting the ratio of the upstream-side and downstream-side liquid passage resistances makes it possible to produce suitable liquid pressure in the tip-end opening of the nozzle by causing the intermediate passage section to contract by a constantly fixed amount. This makes it possible to precisely dispense (perform dropwise addition of, discharge, etc.) microvolume liquid through a simple control.

In particular, in the present invention, when the intermediate passage section is deformed, the ratio of the amount of liquid pushed out from the intermediate passage section to the downstream-side passage section and the amount of liquid pushed back to the upstream-side passage section is set to 1:100-1:500 so that the amount of pushed-out liquid reaches a very small amount; i.e., nanoliter quantities or picoliter quantities. Specifically, the liquid discharge range (e.g., set to 1/100 or 1/500) is determined using the ratio of the upstream-side and downstream-side liquid passage resistances in the intermediate passage section, and the liquid discharge amount is determined using the amount of variation in the volume of the intermediate passage section.

Therefore, of the amount of liquid pushed out from the intermediate passage section in correspondence to the amount by which the interior volume of the intermediate passage section is reduced, a very small amount of liquid is pushed out to the downstream-side passage section, and a corresponding microvolume liquid is dispensed from the tip-end opening of the nozzle. When the liquid is dispensed from the tip-end opening of the nozzle in an amount corresponding to the variation in the interior volume, it is necessary to minutely vary the interior volume and push out nanoliter quantities or picoliter quantities of a microvolume liquid. According to the present invention, the intermediate passage section may be deformed such that liquid of the microliter order is pushed out. Additionally, because the liquid is pushed out toward the downstream side (nozzle side) in a very small amount, it is possible to avoid such a situation that the pressure inside the nozzle temporarily significantly increases, whereby eliminating the risk of a large amount of liquid being dispensed from the tip-end opening of the nozzle. Accordingly, the intermediate passage section and the mechanism for deforming this section can be configured inexpensively, and moreover, it is possible to precisely discharge a microvolume liquid from the tip-end opening of the nozzle at a suitable pressure.

When the deformation of the intermediate passage section is stopped to return the interior volume of the intermediate passage section to the original volume, the ratio of the amount of liquid drawn back into the intermediate passage section from the downstream-side passage section and the amount of liquid drawn into the intermediate passage section from the upstream-side passage section is also 1:100-1:500.

Therefore, when the deformation of the intermediate passage section is stopped to return the interior volume thereof to the original volume, the amount of liquid flowing back toward the intermediate passage section from the nozzle side can be kept to a very small amount. As a result, a suitable state is maintained without breaking the meniscus formed in the tip-end opening of the nozzle. This makes it possible to suitably carry out subsequent operations for dispensing the microvolume liquid.

Consequently, according to the present invention, it is possible to repeat the deformation of the intermediate passage section and the stopping of deformation in a prescribed cycle, and to precisely repeat the dispensing of very small amounts of liquid from the tip-end opening of the nozzle.

In the present invention, it is possible to control a flow-rate-adjusting valve arranged in the upstream-side passage section, increase and decrease the liquid passage resistance of the upstream-side passage section, and adjust the ratio of the amount of liquid pushed out from the intermediate passage section to the downstream-side passage section and the amount of liquid pushed back from the intermediate passage section to the upstream-side passage section. Additionally, it is possible to adjust the ratio of the amount of liquid drawn back into the intermediate passage section from the downstream-side passage section and the amount of liquid drawn into the intermediate passage section from the upstream-side passage section.

In the present invention, it is desirable to configure the nozzle and at least the downstream-side passage section from among the upstream- and downstream-side passage sections as passage sections in which the interior volume does not vary even when the pressure of the liquid flowing through the interior thereof varies. This makes it possible to reliably discharge, from the tip-end opening of the nozzle, a microvolume liquid corresponding to the very small amount of liquid pushed out from the intermediate passage section, since the interior volumes of the downstream-side passage section and nozzle will not vary due to fluctuation of the internal pressure in the intermediate passage section.

In the present invention, it is desirable to: form a sealed outer-peripheral space surrounding the outer periphery of the intermediate passage section; and deform the intermediate passage section into a state of axial symmetry about the central axis of the intermediate passage section so as to reduce the interior volume thereof, as well as stop the deformation, by varying the internal pressure in the sealed outer-peripheral space. Deformation into an axially symmetrical state makes it possible to simplify the management of control over the expansion and contraction of the intermediate passage section to a greater extent than in the case of deformation into an axially asymmetrical state; therefore, it is possible to precisely manage the amount of liquid being pushed out to the nozzle as well.

For example, it is possible to push the liquid out by pressurizing the sealed outer-peripheral space and causing the intermediate passage section to contract, as well as to draw the liquid in by releasing the pressure and returning the intermediate passage section to its original shape. Additionally, a configuration may be adopted in which the liquid is drawn in while the intermediate passage section is in an expanded state due to reduced pressure in the sealed outer-peripheral space, and is pushed out due to the stopping of the reduced pressure and expansion. In order to increase the amount of liquid pushed out and drawn in, a configuration may be adopted in which the liquid is pushed out by pressurizing the sealed outer-peripheral space and causing the intermediate passage section to contract, and is drawn in by reducing the pressure in the sealed outer-peripheral space and causing the intermediate passage section to expand.

The inventors confirmed that it is possible to precisely perform dropwise addition of, discharge, or otherwise dispense a nanoliter-quantity to picoliter-quantity microvolume liquid from a nozzle having a very small diameter of 500 μm or less; e.g., 100 μm or less, which has conventionally been impossible.

Additionally, it was confirmed that it is possible to precisely perform dropwise addition of, discharge, or otherwise dispense a nanoliter-quantity to picoliter-quantity microvolume liquid even when a high-viscosity liquid material, having a viscosity of 1-100 Pa·s, is used as the liquid.

In the present invention, it is possible to precisely dispense a nanoliter-quantity to picoliter-quantity microvolume liquid by controlling the amount and rate of change in the intermediate passage section on the basis of the following parameters: the amount of microvolume liquid dispensed once from the tip-end opening of the nozzle; the inner-diameter dimension of the tip-end opening of the nozzle; the viscosity of the liquid; and the ratio of the upstream-side liquid passage resistance and the downstream-side liquid passage resistance in the intermediate passage section.

Next, according to the present invention, there is provided a microvolume-liquid dispenser for dispensing a nanoliter-quantity to picoliter-quantity microvolume liquid from a tip-end opening in a tubular nozzle, the microvolume-liquid dispenser being characterized by comprising:

a liquid passage having an upstream-side passage section, an intermediate passage section, and a downstream-side passage section, the intermediate passage section being capable of expanding and contracting so as to increase or decrease in interior volume;

a liquid supply part for supplying liquid to the nozzle via the liquid passage;

a passage-deforming mechanism for deforming the intermediate passage section so as to increase or decrease the interior volume of the intermediate passage section; and a control unit;

in a case in which the intermediate passage section is deformed such that the interior volume thereof is reduced while a liquid-filled state is attained in which the liquid fills the portion from the liquid passage to the tip-end opening of the nozzle, the ratio of the amount of liquid pushed out from the intermediate passage section to the downstream-side passage section and the amount of liquid pushed back to the upstream-side passage section being set to 1:100-1:500 so that the amount of pushed-out liquid reaches a very small amount; i.e., nanoliter quantities or picoliter quantities;

the control unit carrying out a microvolume liquid dispensing operation for controlling the passage-deforming mechanism so as to deform the intermediate passage section such that the interior volume thereof is reduced while the liquid-filled state is attained, and causing the microvolume liquid to be dispensed from the tip-end opening of the nozzle due to the very small amount of liquid being pushed out from the intermediate passage section to the downstream-side passage section; and the control unit furthermore carrying out a recovery operation for controlling the passage-deforming mechanism so as to stop the deformation of the intermediate passage section to return the interior volume of the intermediate passage section to the original volume, draw a very small amount of liquid back into the intermediate passage section from the downstream-side passage section, and draw liquid into the intermediate passage section from the upstream-side passage section.

It is desirable to have a unit micromotion mechanism in which members for forming the nozzle and the intermediate passage section and members for forming the downstream-side passage section are caused to move in the central-axis direction of the nozzle as an integrated micromotion unit.

In order to allow these members to move, a member for forming the upstream-side passage section connected to the upstream end of the intermediate passage section in the liquid passage, may be flexible in the direction of movement of the micromotion unit.

When the micromotion unit is caused to move by the unit micromotion mechanism, the gap between the tip-end opening of the nozzle and the workpiece surface to be coated with the microvolume liquid is changed. In order to adjust the gap, the control unit may control the movement of the micromotion unit through the unit micromotion mechanism to carry out a gap control operation for controlling the gap between the tip-end opening of the nozzle and the workpiece surface to be coated with the microvolume liquid droplets.

Suitably setting the gap in accordance with the amount of microvolume liquid to be applied to the workpiece surface, the viscosity of the application liquid, and other factors makes it possible to accurately apply the microvolume liquid to a target position on the workpiece surface, and to apply the microvolume liquid to the workpiece surface in a target application amount. The portion that is moved in order to adjust the gap is compact and lightweight, and includes only the nozzle, the downstream-side passage section, and the intermediate passage section. Accordingly, because there is no prevailing large inertial force, it is possible to carry out very small movements precisely and quickly.

Additionally, an observation optical unit for observing the state of dispensing of the microvolume liquid applied from the tip-end opening of the nozzle to the workpiece surface portion to be coated with the microvolume liquid is arranged in the microvolume-liquid dispenser of the present invention; provided that the control unit controls the movement of the micromotion unit through the unit micromotion mechanism on the basis of the state of dispensing, it is possible to apply the microvolume liquid to the workpiece surface in an appropriate state.

For example, in a case in which a highly viscous microvolume liquid is applied to the workpiece surface or in other such cases, by observing the state of dispensing of the microvolume liquid using the observation optical unit, and carrying out an operation for pulling the nozzle upward at a suitable timing after the microvolume liquid is applied, the flow of liquid can be successfully cut off. This makes it possible to maintain the liquid meniscus of the tip-end opening of the nozzle in a suitable state, and to suitably carry out subsequent operations for applying the microvolume liquid.

It is possible to use a linear-motion mechanism comprising a motor, a ball screw turned by the motor, and a ball nut that slides along the axial direction of the ball screw in correspondence with the turning of the ball screw as the unit micromotion mechanism. In this case, the micromotion unit is mounted on the ball nut, and moves in a reciprocating manner along the central-axis direction of the nozzle.

Subsequently, in the liquid-filled state in which the liquid fills the portion from the liquid supply part through the liquid passage to the tip of the nozzle, when very small air bubbles remain within the liquid passage or the nozzle, it is impossible to suitably carry out the operation for dispensing the microvolume liquid. In order to fill as far as the tip-end opening of the nozzle with liquid so as to avoid the occurrence of residual air bubbles, it is desirable to attain the liquid-filled state in a vacuum atmosphere.

Therefore, it is desirable for the microvolume-liquid dispenser to comprise a vacuum filling mechanism for attaining the liquid-filled state. In this case, the microvolume-liquid dispenser of the present invention has: a dispenser mount to which the liquid supply part, the liquid passage, and the nozzle are detachably attached; and a vacuum filing mechanism for attaining the liquid-filled state, the liquid supply part comprising a liquid reservoir part in which liquid is accumulated. Additionally, the vacuum filling mechanism comprises: a vacuum chamber capable of accommodating the liquid reservoir part, liquid passage, and nozzle once the same are removed from the dispenser mount; and a pressure fluid supply part for supplying a pressure fluid to the liquid reservoir part in order to supply liquid from the liquid reservoir part accommodated in the vacuum chamber to the nozzle via the liquid passage. After the liquid-filling state is attained, the liquid reservoir part, liquid passage, and nozzle can once again be attached to the dispenser mount.

MODE FOR CARRYING OUT THE INVENTION

Embodiments of microvolume-liquid dispensers to which the present invention is applied are described below with reference to the drawings.

First Embodiment

Figure 1:
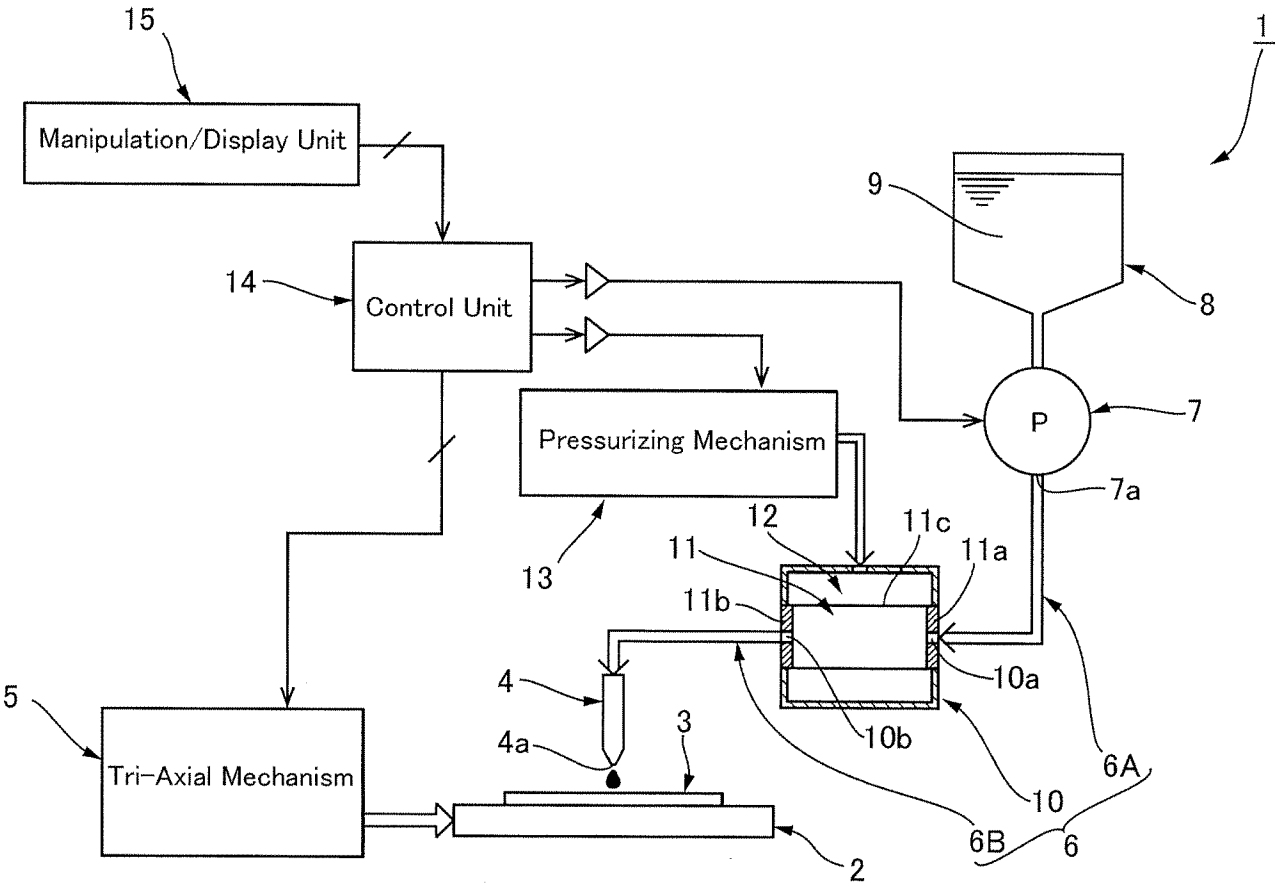
FIG. 1 is an overall structural diagram of a microvolume-liquid dispenser according to a first embodiment to which the present invention is applied.

FIG. 1 is an overall structural diagram of a microvolume-liquid dispenser according to a first embodiment. The microvolume-liquid dispenser 1 comprises a workpiece platform 2, and a nozzle 4 for performing dropwise addition of a microvolume liquid at a prescribed position on, e.g., the surface of a workpiece 3 mounted on the workpiece platform 2. The workpiece platform 2 can be moved in the horizontal plane and in the vertical direction by, e.g., a tri-axial mechanism 5. It is also possible to secure the workpiece platform 2 and cause the nozzle 4 side to move in three axial directions.

In the present example, the nozzle 4 has a long thin cylindrical shape maintained in a perpendicular orientation, and a tip-end opening 4*a* of the nozzle 4 faces the surface of the workpiece 3 such that a suitable very small gap is formed therebetween, the operation for dispensing the microvolume liquid being carried out in this state. A liquid passage 6 having a greater inner diameter than the nozzle inner diameter is connected to the nozzle 4. The liquid passage 6 is connected to a liquid reservoir part 8 with a pump 7 interposed therebetween, a liquid supply part being configured from the pump 7 and the liquid reservoir part 8. It is possible to use, e.g., a Mohno pump or another positive-displacement pump as the pump 7. In the liquid reservoir part 8 is accommodated, e.g., a viscous liquid 9.

The liquid passage 6 is formed from an upstream-side passage section 6A connected to the pump 7, an intermediate passage section 10, and a downstream-side passage section 6B linked to the nozzle 4. The nozzle 4 is cylindrical, comprising a metal or another rigid material, and the downstream-side passage section 6B similarly is cylindrical and comprises a metal or another rigid material; the downstream-side passage section 6B has an inner diameter greater than the nozzle inner diameter, and an interior volume that does not vary due to pressure fluctuations in the viscous liquid flowing through the interior. In the present example, the upstream-side passage section 6A is also formed from a rigid pipe. The upstream-side passage section 6A can instead be formed from a flexible tube.

The intermediate passage section 10 is configured to be a variable-volume passage section. Therefore, in the description below, the intermediate passage section 10 is referred to as a "variable-volume passage section 10." The variable-volume passage section 10 comprises a cylindrical passage 11, the two ends of the cylindrical passage 11 being formed from rigid end plates 11*a*, 11*b*, and a cylindrical barrel part 11*c* being formed from a radially elastically deformable elastic film. The inner diameter of the cylindrical barrel part 11*c* is greater than that of the downstream-side passage section 6B and the upstream-side passage section 6A.

A pressure chamber 12, which is a sealed outer-peripheral space of annular cross-section, is formed coaxially surrounding the cylindrical barrel part 11*c* of the cylindrical passage 11. The pressure chamber 12 is connected to a pressurizing mechanism 13, it being possible to increase the internal pressure of the pressure chamber 12 using the pressurizing mechanism 13. When the pressure chamber 12 is pressurized, the cylindrical barrel part 11*c* of the cylindrical passage 11 contracts radially inward in an axially symmetrical state, and the interior volume of the cylindrical passage 11 decreases. When the pressurization is stopped by the pressurizing mechanism 13, the cylindrical barrel part 11*c* can elastically recover its original cylindrical shape, and the interior volume can return to normal. In this manner, the pressure chamber 12 and the pressurizing mechanism 13 cause the cylindrical passage 11 to flex in an axially symmetrical state, constituting a passage-deforming part for increasing and decreasing the interior volume of the cylindrical passage 11.

It is also possible to use a depressurizing mechanism for reducing the pressure in the pressure chamber 12, in lieu of the pressurizing mechanism 13, as the passage-deforming part. In this case, the viscous liquid 9 is taken into the cylindrical passage 11 in a state in which the interior volume of the cylindrical passage 11 is increased due to the reduced-pressure state, and stopping the reduced-pressure state makes it possible to reduce the interior volume of the cylindrical passage 11 and push out the viscous liquid 9 in the interior. Alternatively, it is also possible to use a pressurizing/depressurizing mechanism in lieu of the pressurizing mechanism 13. In this case, the viscous liquid 9 is taken into the cylindrical passage 11 in a state in which the interior volume of the cylindrical passage 11 is increased due to a reduced-pressure state, and the viscous liquid 9 is pushed out by switching to a pressurized state and reducing the interior volume of the cylindrical passage 11. The amount of the viscous liquid 9 that is pushed out can be increased by increasing or decreasing the interior volume of the cylindrical passage 11.

The driving of each of the liquid-supplying pump 7, pressurizing mechanism 13, and tri-axial mechanism 5 is controlled by a control unit 14. The control operation performed by the control unit 14 is carried out on the basis of manipulation inputs from a manipulation/display unit 15; the state of operations and other information can be displayed on the manipulation/display unit 15.

The nozzle 4 is of very small diameter, and has a long thin cylindrical shape, the inner diameter of the tip-end opening 4*a* being 500 μm or less; e.g., 100 μm. Additionally, the upstream-side passage section 6A upstream of the variable-volume passage section 10 in the liquid passage 6 extends from a discharge port 7*a* of the pump 7 to an upstream end opening 10*a* of the variable-volume passage section 10. The downstream-side passage section 6B downstream of the variable-volume passage section 10 in the liquid passage 6 extends from a rear-end opening of the nozzle 4 to a downstream end opening 10*b* of the variable-volume passage section 10. Because the nozzle 4 is of very small diameter, the liquid passage resistance of the downstream side including the downstream-side passage section 6B and the nozzle 4 is much greater than the liquid passage resistance of the upstream-side passage section 6A.

In the present example, in a case in which the variable-volume passage section 10 contracts such that the interior volume thereof is reduced while a liquid-filled state is attained in which the viscous liquid 9 fills the portion from the liquid passage 6 to the tip-end opening 4*a* of the nozzle 4, the ratio of the amount of liquid pushed out from the variable-volume passage section 10 to the downstream-side passage section 6B and the amount of liquid pushed back to the upstream-side passage section 6A is set within the range of 1:100-1:500 so that the amount of pushed-out liquid reaches a very small amount; i.e., nanoliter quantities or picoliter quantities. Specifically, the liquid passage resistance on the downstream side including the downstream-side passage section 6B and the nozzle 4 is set much greater than the liquid passage resistance of the upstream-side passage section 6A so that such a ratio is attained.

Figure 2:
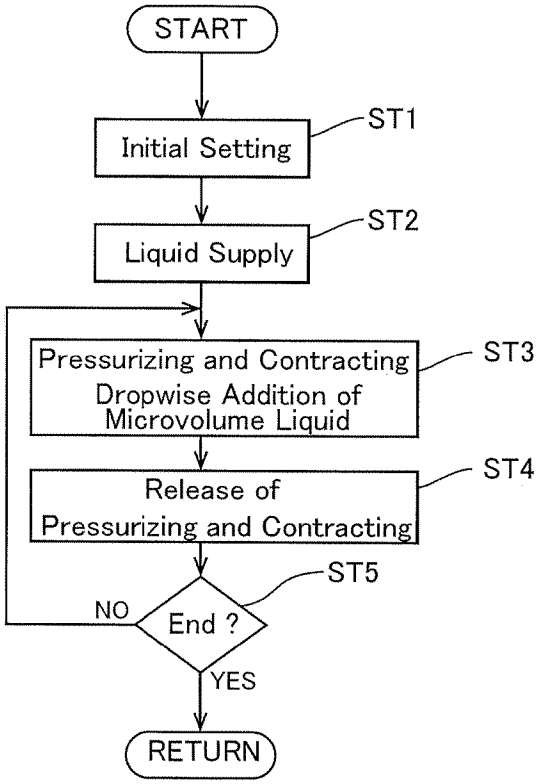
FIG. 2 is a flowchart and a schematic view of the operation of the microvolume-liquid dispenser of FIG. 1.
Figure 2:
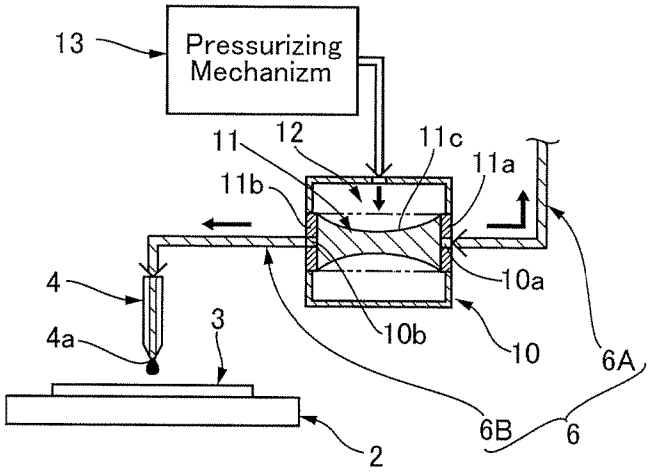
Figure 2:
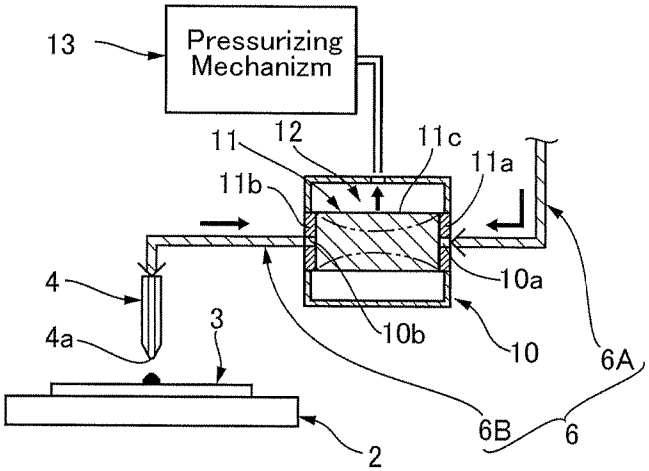

FIG. 2(*a*) is a schematic flowchart of the operation of the microvolume-liquid dispenser 1, and FIGS. 2(*b*) and 2(*c*) are schematic drawings of the movement of the variable-volume passage section 10.

A description is given in accordance with FIG. 2(*a*). First, initial setting operations are carried out, such as mounting the workpiece 3 serving as a subject on the workpiece platform 2, and causing the tip-end opening 4*a* of the nozzle 4 to face, from directly above and with a fixed gap formed therebetween, a position on the workpiece 3 where the microvolume liquid is to be added dropwise (step ST1). The pump 7 is driven to attain a state in which liquid is supplied from the liquid reservoir part 8 to the tip-end opening 4*a* within the nozzle 4 via the liquid passage 6 (step ST2).

In the operation for performing dropwise addition of the microvolume liquid to the workpiece 3, the liquid-supplying pump 7 is set in, e.g., a stopped state, and the pressurizing mechanism 13 is driven to increase the internal pressure in the pressure chamber 12 to a pressure set in advance. The variable-volume passage section 10 is thereby externally pressurized, causing the cylindrical barrel part 11*c* to contract. As a result, as shown in FIG. 2(*b*), the interior volume of the variable-volume passage section 10 decreases (step ST3).

When the variable-volume passage section 10 contracts, the liquid held in the interior thereof is pushed out to each of the downstream end opening 10*b* and the upstream end opening 10*a*, and is branched toward the upstream side and the downstream side. The branched amount of the viscous liquid 9 pushed out toward the downstream side is determined in accordance with the ratio of the liquid passage resistance of the downstream side including the downstream-side passage section 6B and the nozzle 4 and the liquid passage resistance of the upstream-side passage section 6A.

Because the liquid passage resistance on the downstream side is significantly greater, a small amount of liquid is pushed out toward the downstream side. The microvolume liquid pushed out toward the downstream side temporarily increases the internal pressure in the downstream-side passage section 6B, whereby the microvolume liquid of a prescribed volume is added dropwise to the workpiece 3 from the tip-end opening 4*a* of the nozzle 4.

The pressurization performed by the pressurizing mechanism 13 is then stopped, and the pressure chamber 12 is returned to, e.g., an atmospheric-pressure state (step ST4). As a result, as shown in FIG. 2(*c*), the cylindrical barrel part 11*c* of the variable-volume passage section 10 expands radially outward and elastically recovers its original cylindrical shape. Liquid is thereby drawn from both the upstream-side passage section 6A and the downstream-side passage section 6B into the variable-volume passage section 10.

The amount of liquid flowing in also corresponds to the ratio of the upstream-side and downstream-side liquid passage resistances. Accordingly, only a very small amount of liquid is drawn back to the upstream side from the downstream-side passage section 6B on the nozzle 4 side. Therefore, in the tip-end opening 4*a* of the nozzle 4, the interior of the nozzle 4 is pulled upward enough to prevent breaking of the liquid meniscus. Additionally, it is also possible to reliably prevent the occurrence of dripping from the tip-end opening 4*a* after the dropwise addition of the microvolume liquid, as well as other such defects.

In cases in which the microvolume liquid is added dropwise at prescribed intervals along a prescribed length, the operation for performing dropwise addition of the microvolume liquid is carried out as many times as necessary, and operations are thereafter ended (step ST5).

According to the experiment performed by the inventors, it is confirmed that a nozzle having a tip-end opening 4*a* of 25-100 μm can be used as the nozzle 4, and an operation for performing dropwise addition of or discharging a high-viscosity liquid having a viscosity of 50-100 Pa·s in a microvolume of from several tens of picoliters to several nanoliters can be precisely carried out.

The amount and/or rate of contraction of the variable-volume passage section 10 can be appropriately set on the basis of the following parameters: the amount of liquid discharged or added dropwise once from the tip-end opening 4*a* of the nozzle 4; the inner-diameter dimension of the tip-end opening 4*a* of the nozzle 4; the viscosity of the liquid; and the ratio of the liquid passage resistance in the upstream-side passage section 6A and the liquid passage resistance on the downstream side including the downstream-side passage section 6B and the nozzle 4.

Because the nozzle used, the liquid used, the amount of liquid added dropwise in a single cycle, and other such factors are set in advance, a configuration may be adopted in which the control unit 14 carries out drive control for each of the parts in accordance with these factors. The ratio of the upstream-side passage section 6A and the downstream-side passage section 6B can also be variably controlled.

Figure 3:
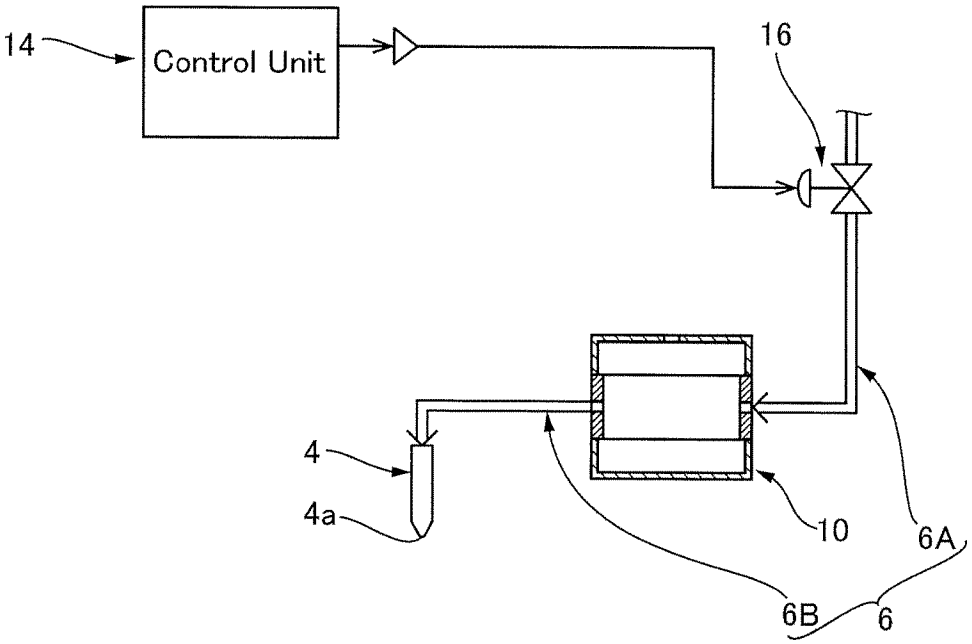
FIG. 3 is a schematic view of a modification example of the microvolume-liquid dispenser of FIG. 1.

For example, as shown in FIG. 3, a flow-rate-adjusting valve 16 can be attached to the upstream-side passage section 6A, and control can be carried out by the control unit 14. Adjusting the flow rate prior to the operation for performing dropwise addition of the microvolume liquid to the workpiece 3 makes it possible to adjust the ratio of the liquid passage resistance of the upstream-side passage section 6A and the liquid passage resistance of the downstream side including the downstream-side passage section 6B and the nozzle 4.

Second Embodiment

Figure 4:
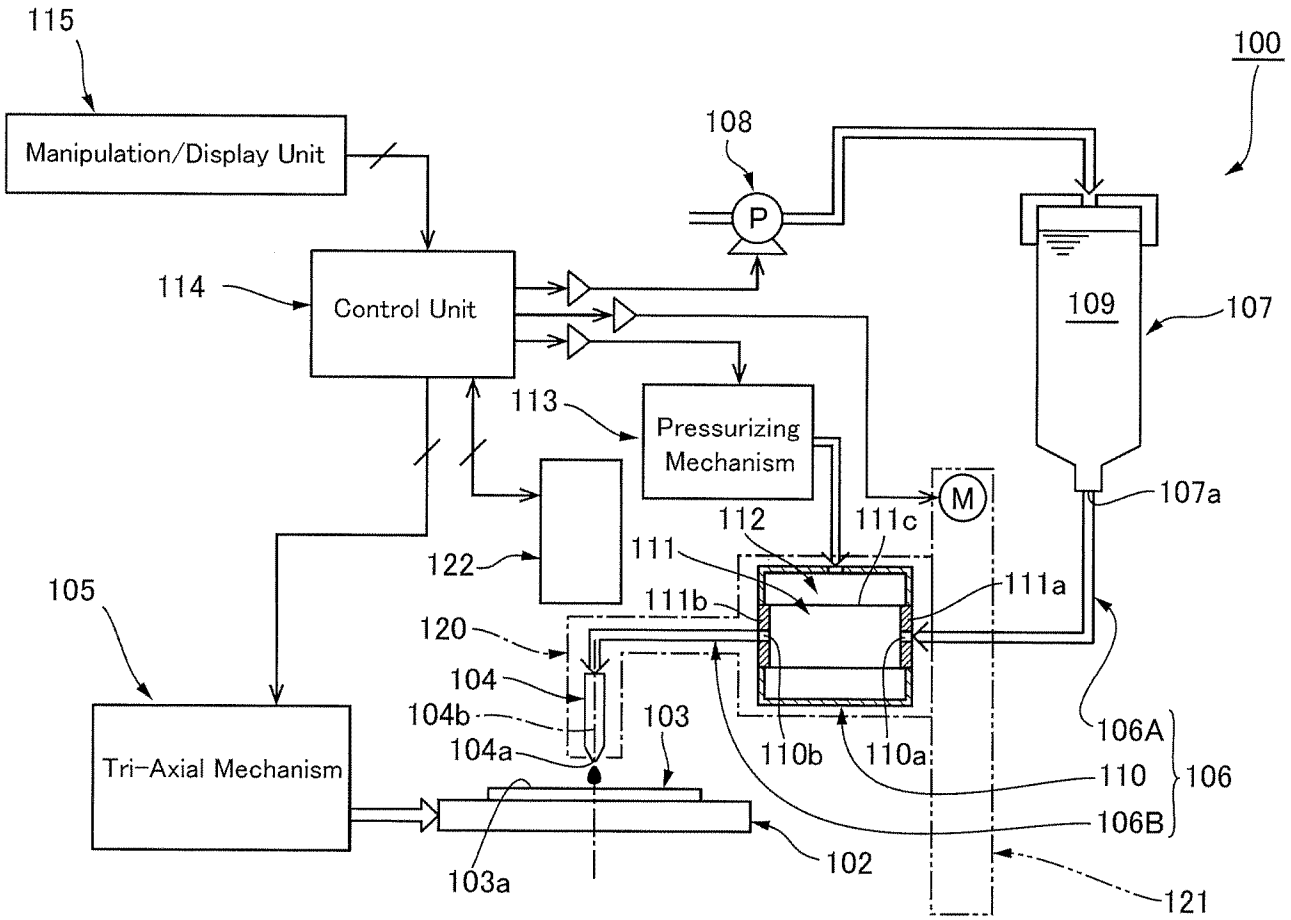
FIG. 4 is an overall structural diagram of a microvolume-liquid dispenser according to a second embodiment to which the present invention is applied.

FIG. 4 is an overall structural diagram of a microvolume-liquid dispenser according to a second embodiment. The microvolume-liquid dispenser 100 comprises a workpiece platform 102, and a nozzle 104 for performing dropwise addition of a microvolume liquid at a prescribed position on, e.g., the surface of a workpiece 103 mounted on the workpiece platform 102. The workpiece platform 102 can be moved in the horizontal plane and in the vertical direction by, e.g., a tri-axial mechanism 105. It is also possible to secure the workpiece platform 102 and cause the nozzle 104 side to move in three axial directions.

In the present example, the nozzle 104 is a long thin cylindrical-shaped nozzle extending in a perpendicular direction. A liquid passage 106 having a greater inner diameter than the inner diameter of the nozzle 104 is connected to the nozzle 104. The liquid passage 106 is connected to a syringe 107 accommodating a liquid. A compressed air is supplied from a pump 108 to the syringe 107, by which the liquid stored therein is supplied to the liquid passage 106. The syringe 107 and the pump 108 constitute a liquid supply part. In the syringe 108, is accommodated, e.g., a viscous liquid 109.

The liquid passage 106 is formed from an upstream-side passage section 106A connected to the outlet port 107*a* of the syringe 107, the outlet port being located at the lower end thereof, an intermediate passage section 110, and a downstream-side passage section 106B connected to the nozzle 104. The nozzle 104 is cylindrical, comprising a metal or another rigid material, and the downstream-side passage section 106B similarly is cylindrical and comprises a metal or another rigid material, in which an interior volume of each of the nozzle and the passage does not vary due to pressure fluctuations in the viscous liquid flowing through the interior. The upstream-side passage section 106A is formed from a flexible tube.

The intermediate passage section 110 is configured to be a variable-volume passage section. The intermediate passage section 110 comprises a cylindrical passage 111, the two ends of the cylindrical passage 111 being formed from rigid end plates 111*a*, 111*b*, and a cylindrical barrel part 111*c* being formed from a radially elastically deformable elastic film. The inner diameter of the cylindrical barrel part 111*c* is greater than that of the downstream-side passage section 106B and the upstream-side passage section 106A.

A pressure chamber 112, which is a sealed outer-peripheral space of annular cross-section, is formed coaxially surrounding the cylindrical barrel part 111*c* of the cylindrical passage 111. The pressure chamber 112 is connected to a pressurizing mechanism 113, it being possible to increase the internal pressure of the pressure chamber 112 using the pressurizing mechanism 113. When the pressure chamber 112 is pressurized, the cylindrical barrel part 111*c* of the cylindrical passage 111 contracts radially inward, and the interior volume of the cylindrical passage 111 decreases. When the pressurization is stopped by the pressurizing mechanism 113, the cylindrical barrel part 111*c* can elastically recover its original cylindrical shape, and the interior volume can return to normal. In this manner, the pressure chamber 112 and the pressurizing mechanism 113 constitute a passage-deforming part for increasing and decreasing the interior volume of the cylindrical passage 111.

It is also possible to use a depressurizing mechanism for reducing the pressure in the pressure chamber 112, in lieu of the pressurizing mechanism 113, as the passage-deforming part. In this case, the viscous liquid 109 is taken into the cylindrical passage 111 in a state in which the interior volume of the cylindrical passage 111 is increased due to the reduced-pressure state, and stopping the reduced-pressure state makes it possible to reduce the interior volume of the cylindrical passage 111 and push out the viscous liquid 109 in the interior. Alternatively, it is also possible to use a pressurizing/depressurizing mechanism in lieu of the pressurizing mechanism 113. In this case, the viscous liquid 109 is taken into the cylindrical passage 111 in a state in which the interior volume of the cylindrical passage 111 is increased due to a reduced-pressure state, and the viscous liquid 109 is pushed out by switching to a pressurized state and reducing the interior volume of the cylindrical passage 111. The amount of the viscous liquid 109 that is pushed out can be increased by increasing or decreasing the interior volume of the cylindrical passage 111.

Here, the nozzle 104, the downstream-side passage section 106B and the intermediate passage section 110 are constituted as a micromotion unit 120 so that they are movable integrally. The micromotion unit 120 is a portion circled by dashed lines in FIG. 4. The micromotion unit 120 can be moved linearly and reciprocally along the center-axis line 104*b* of the nozzle 104 by a linear motion mechanism 121 which is a unit micromotion mechanism (indicated by imaginary lines in FIG. 4). When the micromotion unit 120 is caused to move, the gap between the tip-end opening 104*a* of the nozzle 104 and the workpiece surface 103*a* to be coated mounted on the workpiece platform 102 is increased or decreased.

Additionally, an observation optical unit 122 is arranged above the nozzle 104. The observation optical unit 122 is capable of observing an area including the tip-end opening 104*a* of the nozzle 104 and the workpiece surface 103*a* by means of a CCD camera. The observation optical unit 122 is provided with a laser displacement gauge or another measuring mechanism so that it is capable of measuring the gap between the tip-end opening 104*a* of the nozzle 104 and the workpiece surface 103*a* opposed thereto.

The above-mentioned liquid-supplying pump 108, the pressurizing mechanism 113, the tri-axial mechanism 105, the linear motion mechanism 121, the observation optical unit 122 and other portions are drivingly controlled by a control unit 114. The control by the control unit 104 is carried out based on manipulation inputs from the manipulation part of a manipulation/display unit 115, and working status of each part, images obtained by the observation optical unit 122 and the like can be displayed on the display part of the manipulation/display unit 115.

In the microvolume-liquid dispenser 100 as constituted above, the nozzle 104 is of very small diameter, and has a long thin cylindrical shape, the inner diameter of the tip-end opening 104*a* being 500 μm or less; e.g., 100 μm. Because the nozzle 104 is of very small diameter, the liquid passage resistance on the downstream side of the intermediate passage section 110 is much greater than the liquid passage resistance on the upstream side of the intermediate passage section.

In the present example, in a case in which the intermediate passage section 110 contracts such that the interior volume thereof is reduced while a liquid-filled state is attained in which the viscous liquid 109 fills the portion from the liquid passage 106 to the tip-end opening 104*a* of the nozzle 104, the ratio of the amount of liquid pushed out from the intermediate passage section 110 to the downstream-side passage section 106B and the amount of liquid pushed back to the upstream-side passage section 106A is set within the range of 1:100-1:500 so that the amount of pushed-out liquid reaches a very small amount; i.e., nanoliter quantities or picoliter quantities. Specifically, the liquid passage resistance on the downstream side of the intermediate passage section 110 is set much greater than the liquid passage resistance on the upstream side of the intermediate passage section so that such a ratio is attained.

Figure 5:
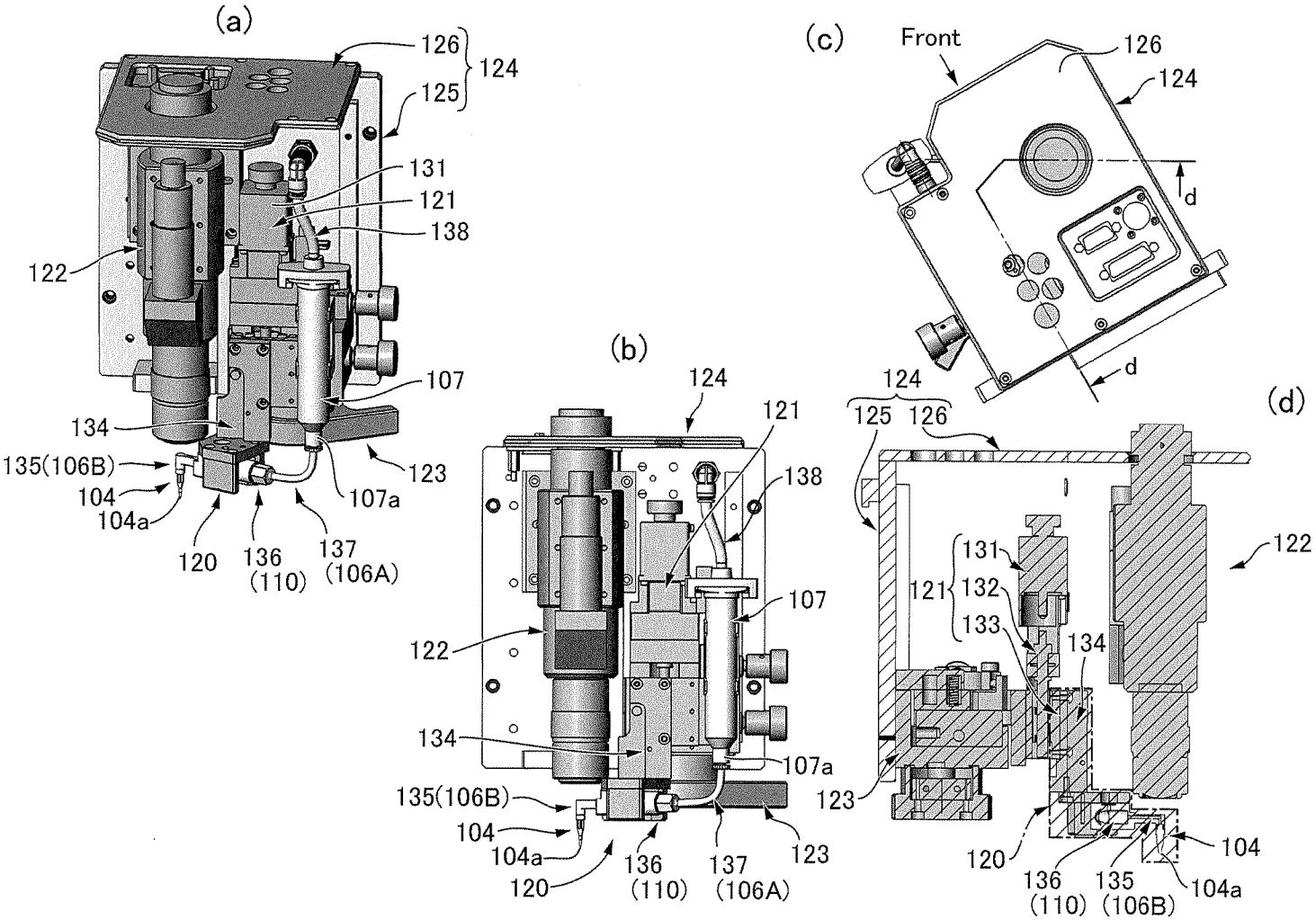
FIG. 5 is a perspective view, a front view, a plan view, and a schematic vertical cross-sectional view of the portion of the mechanism around the nozzle of the microvolume-liquid dispenser of FIG. 4.

FIG. 5(*a*) is an external schematic view showing an example of specific structure of the nozzle and its surrounding part of the microvolume-liquid dispenser 100, FIG. 5(*b*) is a front view thereof, FIG. 5(*c*) is a plan view thereof, and FIG. 5(*d*) is a schematic longitudinal sectional view showing a part cut along d-d line.

In these drawings, a reference numeral 123 depicts a support bloc that is mounted on a dispenser mount not shown in the drawings. Behind the support bloc 123, is mounted a support frame 124 made of metal plate or the like. The support frame 124 comprises a vertical back plate part 125 supported by the support bloc 123, and a top plate part 126 extending horizontally to a front side from the top end of the back plate part.

The linear motion mechanism 121 is supported vertically on the front part of the support bloc 123. The linear motion mechanism 121 has an electric motor 131, a ball screw 132 rotationally driven by the electric motor 131, and a ball nut 133 that slides in the axial direction of the ball screw 132 according to the rotation of the ball screw 132. The electric motor 131 is placed vertically in a downward orientation, and the ball screw 132 is linked to the motor coaxially on the lower side thereof.

A vertical mounting plate 134 is attached on the front side part of the ball nut 133. The micromotion unit 120 is mounted on the lower part of the vertical mounting plate 134. The micromotion unit 120 is a unit constituted by the nozzle 104, a passage pipe 135 defining the downstream-side passage section 106B therein, a passage pipe 136 defining the intermediate passage section 110 therein, and the vertical mounting plate 134. The intermediate passage section 110 is connected to the pressurizing mechanism (see FIG. 4) via a not-shown piping system.

A flexible tube 137 defines the upstream-side passage section 106A in the interior thereof, the upstream-side passage being connected to the upstream end of the intermediate passage section 110 of the micromotion unit 120. The flexible tube 137 is extended from its part connected to the upstream-side passage section 106A in an approximately horizontal direction, and then bent and extended upward, the upstream end of the flexible tube being connected to the outlet port 107*a* of the syringe 107. Thus, the flexible tube 137 is capable of flexing in the vertical direction in accordance with the movement of the micromotion unit 120 along the vertical direction (the nozzle center-axial direction).

The syringe 107 has a cylindrical shape as a whole, the lower end part thereof is tapered in a truncated cone shape, and the lower end defines the outlet port 107*a*. The syringe 107 is attached to the support bloc 123 adjacent to the linear motion mechanism 121 in a vertical orientation with the outlet port 107*a* facing downward. A compressed-air supply pipe 138 is connected to the inlet port side of the syringe 107 at the upper side, the supply pipe 138 being connected to the outlet port of the pump 108 for supplying compressed air (see FIG. 4) through the back plate portion 125 of the support frame 124.

The observation optical unit 122 is positioned at the opposite side from the syringe 107 with respect to the linear motion mechanism 121. The observation optical unit 122 is supported by the back plate part 125 of the support frame 124.

Figure 6:
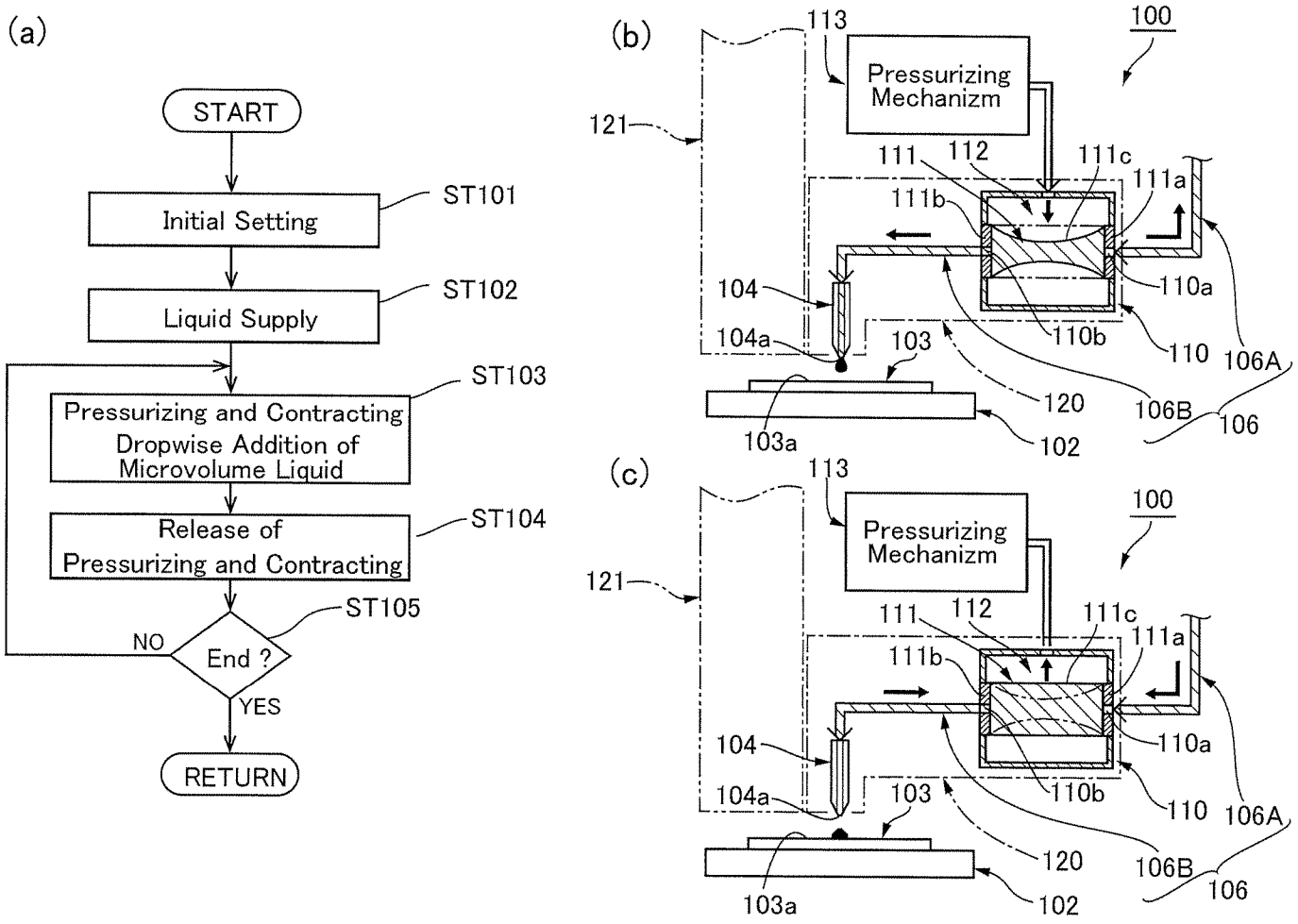
FIG. 6 is a flowchart and a schematic view of the operation of the microvolume-liquid dispenser of FIG. 4.

FIG. 6(*a*) is a schematic flowchart of the operation of the microvolume-liquid dispenser 100, and FIGS. 6(*b*) and 6(*c*) are explanatory views of the movement of the intermediate passage section 110.

A description is given in accordance with these drawings. First, initial setting operations are carried out, such as mounting the workpiece 103 serving as a subject on the workpiece platform 102, and causing the tip-end opening 104*a* of the nozzle 104 to face, from directly above and with a fixed gap formed therebetween, a position on the workpiece 3 where the microvolume liquid is to be added dropwise (step ST101).

In this operation, the tri-axial mechanism 105 is driven by the control unit 114 to position the tip-end opening 104*a* of the nozzle 104 at the start point for liquid application. Then, the control unit 114 controls to drive the linear motion mechanism 121 so that the micromotion unit 120 is caused to move minutely in the vertical direction, whereby the gap between the tip-end opening 104*a* of the nozzle 104 and the workpiece surface 103*a* is finely adjusted. In the fine adjustment of gap, it is sufficient to only move the micromotion unit 120 vertically. Thus, the gap adjustment can be made precisely and rapidly in comparison with such a case, for example, in which the entire mechanism section surrounding the nozzle 104 shown in FIG. 5 is moved vertically.

Thereafter, the pump 108 is driven to control supply of compressed air, whereby attaining a state in which liquid is supplied from the syringe 107 to the tip-end opening 104*a* within the nozzle 104 via the liquid passage 106 (step ST102 of FIG. 6(*a*)).

In the operation for performing dropwise addition of the microvolume liquid to the workpiece 103, the supplying operation of liquid is stopped by setting the pump 108 to stop supplying compressed air to the syringe 107, and the pressurizing mechanism 113 is driven to increase the internal pressure in the pressure chamber 112 to a pressure set in advance. The intermediate passage section 110 is thereby externally pressurized, causing the cylindrical barrel part 111*c* to contract. As a result, as shown in FIG. 6(*b*), the interior volume of the intermediate passage section 110 decreases (step ST103 of FIG. 6(*a*)).

When the intermediate passage section 110 contracts, the liquid held in the interior thereof is pushed out to each of the downstream end opening 110*b* and the upstream end opening 110*a*, and is branched toward the upstream side and the downstream side. The branched amount of the viscous liquid 109 pushed out toward the downstream side is determined in accordance with the ratio of the liquid passage resistance of the downstream side including the downstream-side passage section 106B and the nozzle 104 and the liquid passage resistance of the upstream-side passage section 106A.

Because the liquid passage resistance on the downstream side is significantly greater, a small amount of liquid is pushed out toward the downstream side. The microvolume liquid pushed out toward the downstream side temporarily increases the internal pressure in the downstream-side passage section 106B, whereby the microvolume liquid of a prescribed volume is added dropwise to the workpiece surface 103*a* from the tip-end opening 104*a* of the nozzle 104.

The pressurization performed by the pressurizing mechanism 113 is then stopped, and the pressure chamber 112 is returned to, e.g., an atmospheric-pressure state (step ST104 of FIG. 6(*a*)). As a result, as shown in FIG. 6(*c*), the cylindrical barrel part 111*c* of the intermediate passage section 110 expands radially outward and elastically recovers its original cylindrical shape. Liquid is thereby drawn from both the upstream-side passage section 106A and the downstream-side passage section 106B into the intermediate passage section 110.

The amount of liquid flowing in also corresponds to the ratio of the upstream-side and downstream-side liquid passage resistances. Accordingly, only a very small amount of liquid is drawn back to the upstream side from the downstream-side passage section 106B on the nozzle 104 side. Therefore, in the tip-end opening 104*a* of the nozzle 104, the liquid meniscus is pulled upward in the nozzle 104 to only an extent that the liquid meniscus is prevented from breaking. Additionally, it is also possible to reliably prevent the occurrence of liquid dripping from the tip-end opening 104*a* after the dropwise addition of the microvolume liquid, as well as other such defects.

Here, in the operation for performing dropwise addition of the microvolume liquid, the gap between the tip-end opening 104*a* of the nozzle 104 and the workpiece surface 103*a* is adjusted to be a narrow gap. Accordingly, in the operation for performing dropwise addition of highly viscos liquid, there is a possibility that the microvolume liquid added dropwise on the workpiece surface 103*a* does not separate from the tip-end opening 104*a* of the nozzle 104 but forms a state spanning to the workpiece surface 103*a*.

In such an operation for performing application of liquid with high viscosity, for example, a preliminary operation for performing dropwise addition is carried out and in a case in which the above-mentioned spanning state is confirmed by the observation optical unit 122, the linear motion mechanism 121 is driven to cause the micromotion unit 120 to finely move, to thereby draw up the nozzle 104 at an appropriate timing during the operation of performing dropwise addition of the microvolume liquid. With this operation, the liquid spanning between the nozzle and the workpiece surface can be cut efficiently, and microvolume liquid can be applied on the workpiece surface 103*a* precisely in an appropriate condition. In this case, since it is only required to finely move the micromotion unit 120, the timing and the amount of the nozzle 104 to draw up can be precisely controlled.

In cases in which the microvolume liquid is added dropwise at prescribed intervals along a prescribed length, the operation for performing dropwise addition of the microvolume liquid is carried out as many times as necessary, and operations are thereafter ended (step ST105 of FIG. 6(*a*)).

According to the experiment performed by the inventors, it is confirmed that a nozzle having a tip-end opening 4*a* of 25-100 μm can be used as the nozzle 104, and an operation for performing dropwise addition of or discharging a high-viscosity liquid having a viscosity of 50-100 Pa·s in a microvolume of from several tens of picoliters to several nanoliters can be precisely carried out.

The amount and/or rate of contraction of the intermediate passage section 110 can be appropriately set on the basis of the following parameters:

the amount of liquid discharged or added dropwise once from the tip-end opening 104*a* of the nozzle 104;

the inner-diameter dimension of the tip-end opening 104*a* of the nozzle 104;

the viscosity of the liquid; and the ratio of the liquid passage resistance in the upstream-side passage section 106A and the liquid passage resistance in the downstream side including the downstream-side passage section 106B and the nozzle 104.

Because the nozzle used, the liquid used, the amount of liquid added dropwise in a single cycle, and other such factors are set in advance, a configuration may be adopted in which the control unit 114 carries out drive control for each of the parts in accordance with these factors. The ratio of the upstream-side passage section 106A and the downstream-side passage section 106B can also be variably controlled.

Figure 7:
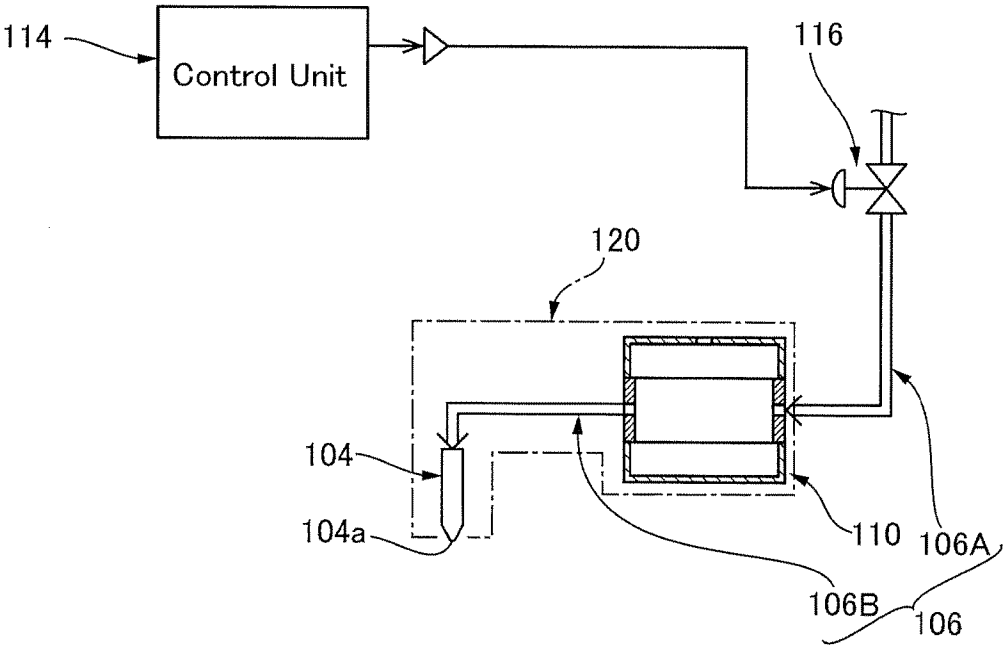
FIG. 7 is a schematic view of a modification example of the microvolume-liquid dispenser of FIG. 4.

For example, as shown in FIG. 7, a flow-rate-adjusting valve 116 can be attached to the upstream-side passage section 106A, and control thereof can be carried out by the control unit 114. Adjusting the flow rate prior to the operation for performing dropwise addition of the microvolume liquid to the workpiece 103 makes it possible to adjust the ratio of the liquid passage resistance of the upstream-side passage section 106A and the liquid passage resistance of the downstream side including the downstream-side passage section 106B and the nozzle 104.

[Vacuum Filling Mechanism]

Figure 8:
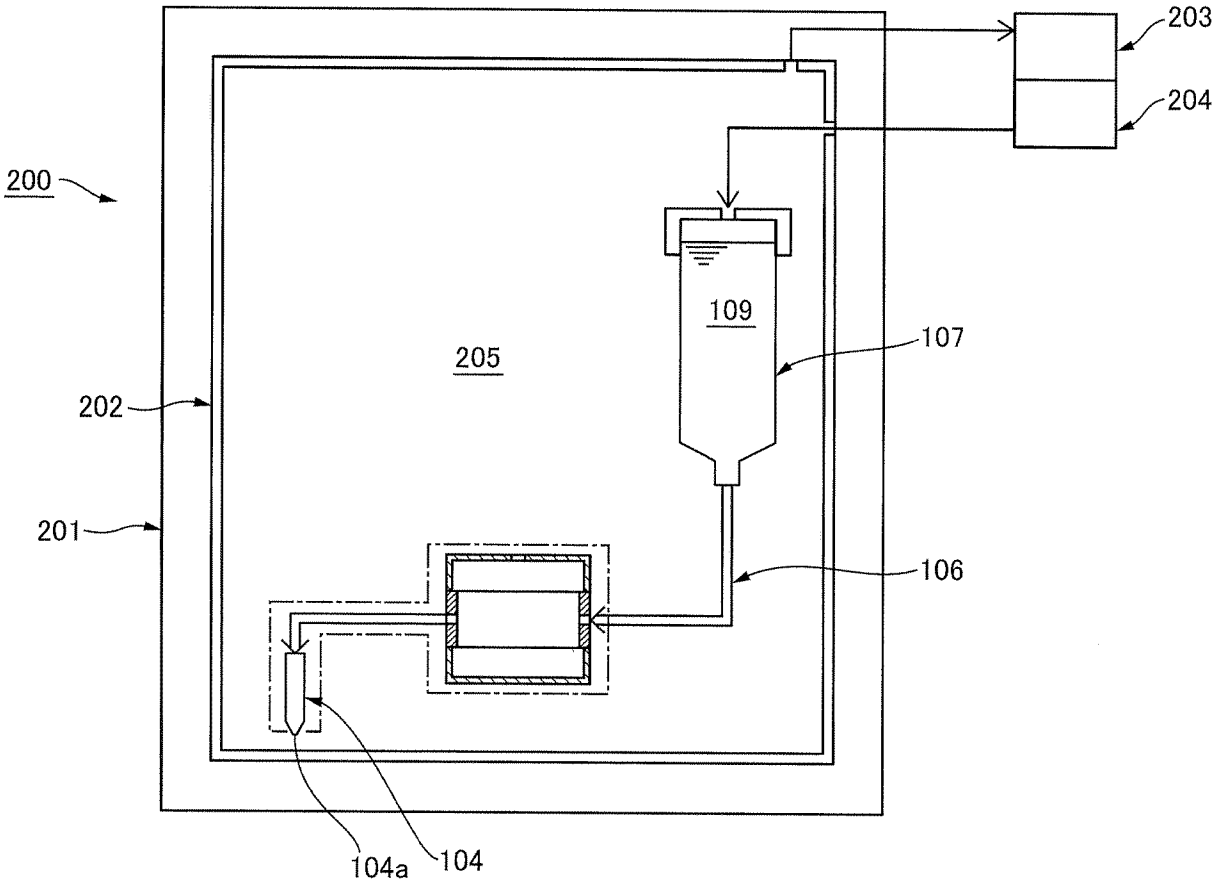
FIG. 8 is a schematic view of one example of a vacuum filling mechanism using the microvolume-liquid dispenser of FIG. 4.

FIG. 8 is an explanatory view showing an example of a vacuum filling mechanism that is suitable for use in the microvolume-liquid dispenser 100 of the second embodiment. The vacuum filling mechanism 200 is used to attain a state in which liquid is filled from the syringe 107 to the tip-end opening 104*a* of the nozzle 104 via the liquid passage 106 without residual air bubbles. Such a configuration can be adopted that the vacuum filling mechanism 200 is assembled to the dispenser frame of the microvolume liquid dispenser 100. Alternatively, it is possible to manufacture the vacuum filling mechanism 200 as an accessory unit independent of the microvolume liquid dispenser 100.

The vacuum filling mechanism 200 has a mechanism frame 201, a vacuum chamber 202 mounted on the mechanism frame 201, and a vacuum suction source 203 and pressure fluid supply source 204. In the microvolume-liquid dispenser 100, the syringe 107 (liquid reservoir part), the liquid passage 106 and the nozzle 104 can be attached to or removed from the support bloc 123 on the dispenser side while they remain in a connected state. The syringe 107, the liquid passage 106 and the nozzle 104 once removed from the microvolume liquid dispenser 100 can be attached to or removed from an attachment plate 205 forming the bottom surface of the vacuum chamber 202 with maintaining their connected state.

A prescribed vacuum condition can be formed inside the vacuum chamber 202 by using the vacuum suction source 203. The syringe 107 attached to the attachment plate 205 can be supplied with a pressure fluid such as compressed air for use in liquid filling operation.

As shown in FIG. 8, the vacuum chamber 202 of the vacuum filling mechanism 200 is made open. Then, the syringe 107 which has already been filled with liquid, the liquid passage 106 and the nozzle 104 are attached to a prescribed position on the attachment plate 205, and are made in a connected condition. The syringe 107 is filled with a certain amount of liquid in a defoamed condition.

After the vacuum chamber 202 is closed, a certain degree of vacuum condition is formed inside the vacuum chamber 202 by means of the vacuum suction source 203. Whereby, air is removed from the inside of the liquid passage 106 and the nozzle 104.

In this state, the pressure fluid supply source 204 is used to pressurize the syringe 107 to cause the liquid 109 stored therein in a defoamed condition to discharge toward the liquid passage 106. As a result, the liquid is filled in the liquid passage 106 and the nozzle 104. Since the liquid is filled in a vacuum suction state, it is possible to fill liquid in the intermediate passage section 110 and other parts without residual air bubbles.

After the liquid-filled condition is formed as mentioned above, the syringe 107, the liquid passage 106 and the nozzle 104 while maintaining in a connected state are taken out of the vacuum chamber 202, and are returned to the side of the dispenser frame of the microvolume-liquid dispenser 100.

Using the vacuum filling mechanism 200 makes it possible to surely avoid poor discharge of microvolume liquid and other defects due to residual air bubbles, whereby precisely dispensing microvolume liquid on the surface of the workpiece 103 from the nozzle 104.

The method and dispenser of the present invention can be used for dispensing (dropwise adding, discharging and the like) a variety of liquid. Examples of such liquid materials are:

metal pastes (Ag, Cu, solders et.al);

resin liquid materials (silicone adhesives, UV curing resins, phot resist materials, UV curing adhesives, and other resin liquid agents); and filler-filled liquid materials (in which fillers include fluorescence particles, silica particles, fritted glasses, titanium oxide, various nano and micro particles et.al).

Additionally, the present invention can be applied for various industrial fields such as:

optical component manufacturing (coating of shield materials, aperture formation, coating of various liquids on lens surfaces);

dropwise addition of microvolume-liquid adhesive on electronic components (LEDs, crystal oscillation elements, MEMS, power devices et. al);

glass lamination in FPDs and image sensors; and wiring of Ag nano pastes (supporting wiring to ITOs, wiring to micro areas et.al).

The invention claimed is:

1. A microvolume-liquid dispensing method comprising:

dispensing a nanoliter-quantity to picoliter-quantity microvolume liquid from a tip-end opening in a tubular nozzle, wherein a liquid passage for supplying liquid from a liquid supply part to the nozzle is formed from an upstream-side passage section, an intermediate passage section, and a downstream-side passage section, the intermediate passage section being configured to expand and contract so as to increase or decrease in interior volume, wherein an interior volume of the nozzle and the downstream-side passage section do not vary when a pressure of liquid flowing therethrough varies;

when the intermediate passage section is deformed such that the interior volume thereof is reduced while a liquid-filled state is attained in which the liquid fills a portion from the liquid passage to the tip-end opening of the nozzle, a ratio of an amount of liquid pushed out from the intermediate passage section to the downstream-side passage section and an amount of liquid pushed back to the upstream-side passage section is set to 1:100-1:500 so that the amount of pushed-out liquid is a nanoliter or picoliter quantity;

in an operation for dispensing the microvolume liquid, when the liquid-filled state is attained, the intermediate passage section is deformed such that the interior volume thereof is reduced;

the microvolume liquid is dispensed from the tip-end opening of the nozzle due to the liquid pushed out from the intermediate passage section to the downstream-side passage section;

the deformation of the intermediate passage section is stopped to return the interior volume of the intermediate passage section to an original volume, draw liquid back into the intermediate passage section from the downstream-side passage section, and draw liquid into the intermediate passage section from the upstream-side passage section; and a flow-rate-adjusting valve arranged in the upstream-side passage section is controlled so as to increase or decrease the liquid passage resistance of the upstream-side passage section by adjusting the ratio of the amount of liquid pushed out from the intermediate passage section to the downstream-side passage section and the amount of liquid pushed back from the intermediate passage section to the upstream-side passage section.

2. The microvolume-liquid dispensing method according to claim 1, wherein a sealed outer-peripheral space surrounding an outer periphery of the intermediate passage section is formed; and the intermediate passage section is deformed into a state of axial symmetry about a central axis of the intermediate passage section so as to reduce the interior volume thereof, and the deformation thereof is stopped, by varying an internal pressure in the sealed outer-peripheral space.

3. The microvolume-liquid dispensing method according to claim 1, wherein the nozzle has a diameter of 500 μm or less.

4. The microvolume-liquid dispensing method according to claim 1, wherein the liquid dispensed has a viscosity of 1-100 Pa·s.

5. The microvolume-liquid dispensing method according to claim 1, wherein the amount and rate of change in the intermediate passage section are controlled on the basis of the following parameters:

the amount of microvolume liquid dispensed once from the tip-end opening of the nozzle;

the inner-diameter dimension of the tip-end opening of the nozzle;

the viscosity of the liquid; and the ratio of the upstream-side liquid passage resistance and the downstream-side liquid passage resistance in the intermediate passage section.

6. The microvolume-liquid dispensing method according to claim 1, wherein the deformation of the intermediate passage section and the stopping of deformation are repeated in a prescribed cycle, to thereby repeat the dispensing of liquid from the tip-end opening of the nozzle.

7. A microvolume-liquid dispenser for dispensing a nanoliter-quantity to picoliter-quantity microvolume liquid from a tip-end opening in a tubular nozzle, the microvolume-liquid dispenser comprising:

a liquid passage having an upstream-side passage section, an intermediate passage section, and a downstream-side passage section, the intermediate passage section being capable of expanding and contracting so as to increase or decrease in interior volume, wherein an interior volume of the nozzle and the downstream-side passage do not vary when a pressure of liquid flowing therethrough varies;

a liquid supply part for supplying liquid to the nozzle via the liquid passage;

a passage-deforming mechanism for deforming the intermediate passage section so as to increase or decrease the interior volume of the intermediate passage section; and a control unit;

the intermediate passage section is constructed such that when the intermediate passage section is deformed such that the interior volume thereof is reduced while a liquid-filled state is attained in which the liquid fills a portion from the liquid passage to the tip-end opening of the nozzle, a ratio of an amount of liquid pushed out from the intermediate passage section to the downstream-side passage section and an amount of liquid pushed back to the upstream-side passage section being set to 1:100-1:500 so that the amount of pushed-out liquid is a nanoliter or picoliter quantity;

the control unit configured to carry out a microvolume liquid dispensing operation for controlling the passage-deforming mechanism so as to deform the intermediate passage section such that the interior volume thereof is reduced while the liquid-filled state is attained, and causing the microvolume liquid to be dispensed from the tip-end opening of the nozzle due to the liquid being pushed out from the intermediate passage section to the downstream-side passage section;

the control unit being further configured to carry out a recovery operation for controlling the passage-deforming mechanism so as to stop the deformation of the intermediate passage section to return the interior volume of the intermediate passage section to an original volume, draw liquid back into the intermediate passage section from the downstream-side passage section, and draw liquid into the intermediate passage section from the upstream-side passage section; and a flow-rate-adjusting valve arranged in the upstream-side passage section; wherein the control unit is configured to control the flow-rate-adjusting valve so as to allow the liquid passage resistance of the upstream-side passage section to increase or decrease by adjusting the ratio of the amount of liquid pushed out from the intermediate passage section to the downstream-side passage section and the amount of liquid pushed back from the intermediate passage section to the upstream-side passage section.

8. The microvolume-liquid dispenser according to claim 7, wherein the passage-deforming mechanism has an internal pressure adjusting mechanism for varying an internal pressure in a sealed outer-peripheral space surrounding an outer periphery of the intermediate passage section so that the intermediate passage section is deformed into a state of axial symmetry about a central axis of the intermediate passage section so as to reduce the interior volume thereof.

9. The microvolume-liquid dispenser according to claim 7, wherein the nozzle has a diameter of 500 μm or less.

10. The microvolume-liquid dispenser according to claim 7, in combination with the liquid supplied from the liquid supply part, wherein the liquid has a viscosity of 1-100 Pa·s.

11. The microvolume-liquid dispenser according to claim 7, wherein the control unit controls the amount and rate of change in the intermediate passage section based on at least one of the following parameters:

an amount of microvolume liquid dispensed once from the tip-end opening of the nozzle;

an inner-diameter dimension of the tip-end opening of the nozzle; the viscosity of the liquid; and the ratio of the upstream-side liquid passage resistance and the downstream-side liquid passage resistance in the intermediate passage section.

12. The microvolume-liquid dispenser according to claim 7, wherein the control unit controls to repeat the microvolume liquid dispensing operation and the recovery operation in a prescribed cycle.

13. The microvolume-liquid dispenser according to claim 7, further comprising:

a unit micromotion mechanism for moving members for forming the nozzle and intermediate passage section and members for forming the downstream-side passage section in the central-axis direction of the nozzle as an integrated micromotion unit.

14. The micorovolume-liquid dispenser according to claim 13, wherein a member for forming the upstream-side passage section is flexible in the direction of movement of the micromotion unit.

15. The microvolume-liquid dispenser according to claim 13, wherein the control unit controls the movement of the micromotion unit by means of the unit micromotion mechanism to carry out a gap control operation for controlling the gap between the tip-end opening of the nozzle and the workpiece surface to be coated with the microvolume liquid droplets.

16. The microvolume-liquid dispenser according to claim 15, further comprising:

an observation optical unit for observing the state of dispensing of the microvolume liquid applied from the tip-end opening of the nozzle to the workpiece surface portion to be coated with the microvolume liquid; wherein the control unit controls the movement of the micromotion unit by means of the unit micromotion mechanism on the basis of the state of dispensing.

17. The microvolume-liquid dispenser according to claim 13, wherein the unit micromotion mechanism is a linear-motion mechanism having a motor, a ball screw turned by the motor, and a ball nut that slides along the axial direction of the ball screw in correspondence with the turning of the ball screw; and the micromotion unit is mounted on the ball nut.

18. The microvolume-liquid dispenser according to claim 13, further comprising:

a dispenser mount to which the liquid supply part, the liquid passage, and the nozzle are attached; and a vacuum filling mechanism for attaining the liquid-filled state, wherein the liquid supply part has a liquid reservoir part in which liquid is accumulated, the vacuum filling mechanism has: a vacuum chamber capable of accommodating the liquid reservoir part, the liquid passage, and the nozzle after these three parts are removed from the dispenser mount; and a pressure fluid supply part for supplying a pressure fluid to the liquid reservoir part in order to supply liquid from the liquid reservoir part accommodated in the vacuum chamber to the nozzle via the liquid passage, and wherein the liquid reservoir part, the liquid passage, and the nozzle after the liquid-filling state is attained, can be attached to the dispenser mount.

* * * * *